US007230883B2

(12) United States Patent
Marhic et al.

(10) Patent No.: US 7,230,883 B2
(45) Date of Patent: Jun. 12, 2007

(54) TIDE DISPLAY DEVICE

(75) Inventors: Alain Marhic, Bidart (FR); Nicolas Foulet, Capbreton (FR); Carine Vidoudez, Biarritz (FR); Todd Finney, Tustin, CA (US); Juan Gonzalez Vega, Huntington Beach, CA (US); Matt Anderson, Huntington Beach, CA (US)

(73) Assignee: Quiksilver, Inc., Huntington Beach, CA (US)

( * ) Notice: Subject to any disclaimer, the term of this patent is extended or adjusted under 35 U.S.C. 154(b) by 230 days.

(21) Appl. No.: 11/053,162

(22) Filed: Feb. 7, 2005

(65) Prior Publication Data

US 2005/0190652 A1 Sep. 1, 2005

Related U.S. Application Data

(60) Provisional application No. 60/546,636, filed on Feb. 20, 2004.

(51) Int. Cl.
*G04B 47/00* (2006.01)
*G04B 19/26* (2006.01)

(52) U.S. Cl. ..... 368/10; 368/19

(58) Field of Classification Search ..... 368/10, 368/15, 19, 28, 29, 223; 701/213, 219; 702/3, 702/5

See application file for complete search history.

(56) References Cited

U.S. PATENT DOCUMENTS

| | | | | |
|---|---|---|---|---|
| 3,899,668 | A * | 8/1975 | Tucker, Jr. | 702/55 |
| 4,412,749 | A | 11/1983 | Showalter | 368/19 |
| 5,115,417 | A | 5/1992 | Saunders | 368/19 |
| 5,293,355 | A | 3/1994 | Widen et al. | 368/19 |
| 5,299,126 | A | 3/1994 | Spraker | 368/19 |
| 5,347,497 | A * | 9/1994 | Allen | 368/19 |
| 5,363,307 | A * | 11/1994 | Yoshida | 701/219 |
| 5,579,289 | A * | 11/1996 | Kerr | 368/19 |
| 6,295,248 | B1 | 9/2001 | Nakamura | 368/19 |
| 2003/0033087 | A1 | 2/2003 | Yuzuki | 702/5 |
| 2003/0167124 | A1 * | 9/2003 | Bowden | 702/2 |

* cited by examiner

*Primary Examiner*—Vit W. Miska

(57) ABSTRACT

A tide display device comprises a storage mechanism that stores tide information by surf spot. The device has a microprocessor that is programmed to display the tide height both graphically and numerically.

38 Claims, 2 Drawing Sheets

FIG. 1
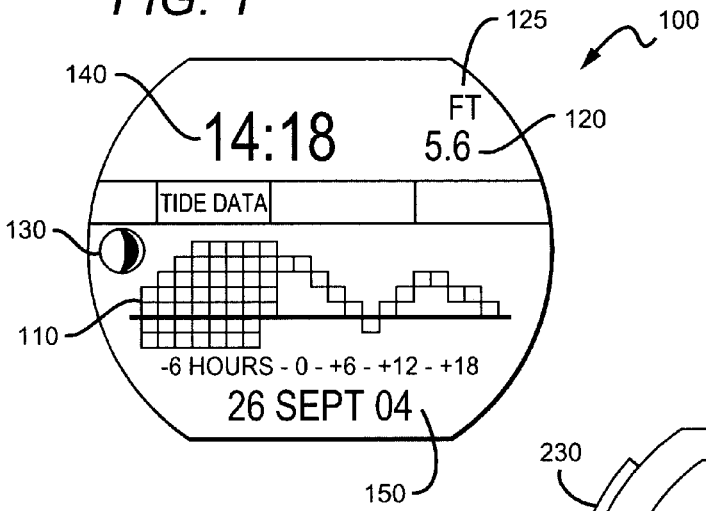
FIG. 2
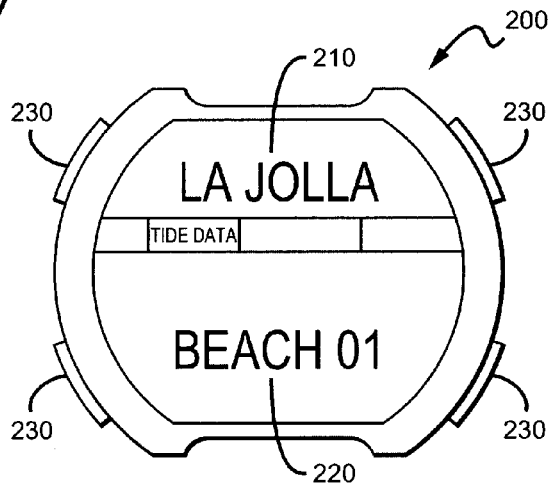
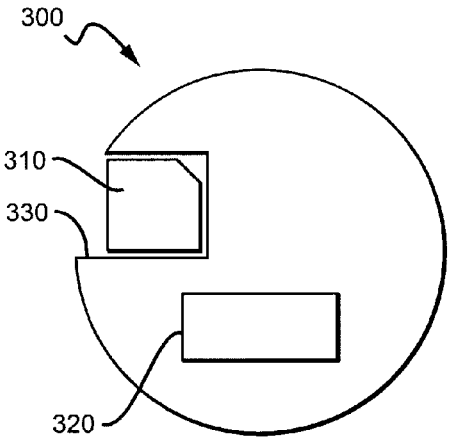
FIG. 3
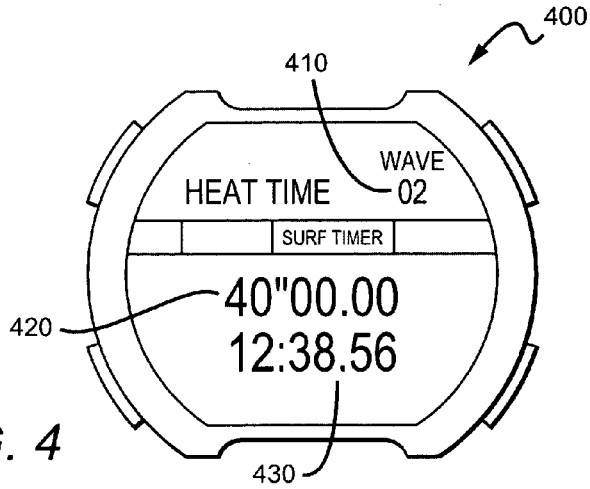
FIG. 4

FIG. 5
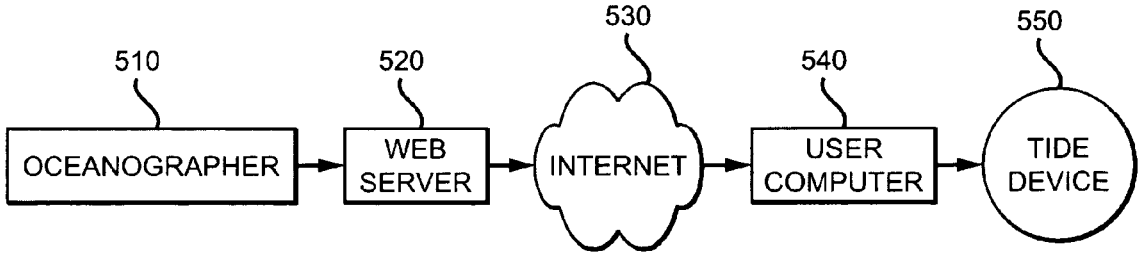
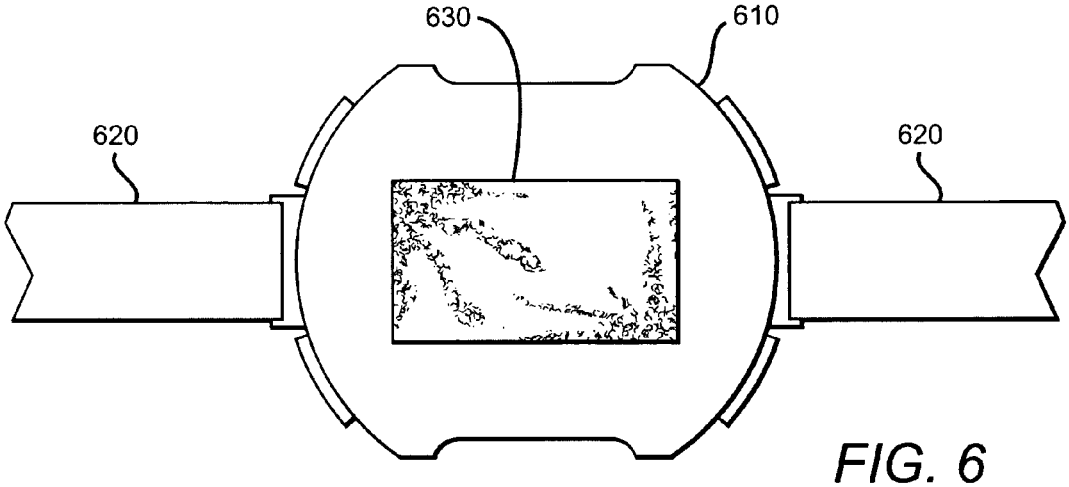
FIG. 6
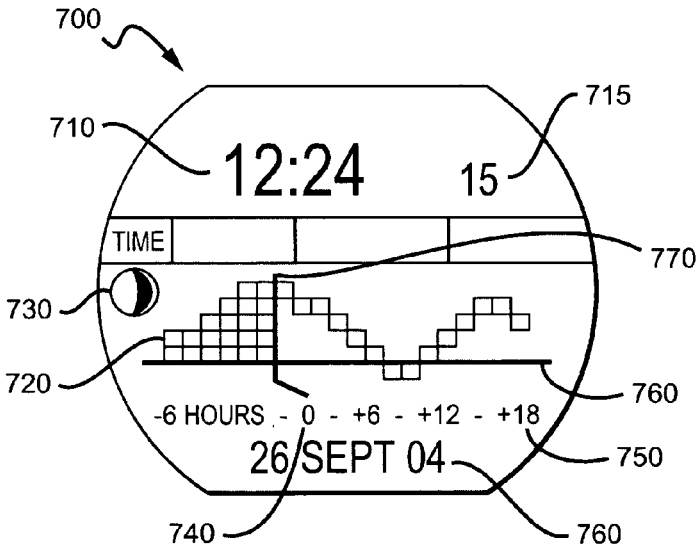
FIG. 7

TIDE DISPLAY DEVICE

This application claims the benefit of U.S. provisional application No. 60/546636 filed on Feb. 20, 2004 incorporated herein by reference in its entirety.

FIELD OF THE INVENTION

The field of the invention is horology.

BACKGROUND OF THE INVENTION

Early tide display devices did not have enough memory to store any significant amount of future tide information and therefore they were programmed to calculate the occurrence of high and low tides based on a mathematical algorithm. One such device is taught in U.S. Pat. No. 4,412,749 issued to Showalter in November 1983. As it became less prohibitive to store large amounts of data, tide display devices were pre-loaded with future tide heights. While in many cases the devices were loaded with accurate data, many of the early devices, particularly watches, failed to display the information with enough specificity so as to be meaningful to the user. For example, the watch taught in U.S. Pat. No. 5,293,355 displays the times for the high and low tides but does not indicate the height of the highs and lows. Another example is the watch taught in U.S. Pat. No 5,115,417 which represents tide height using a "tide height bar". The tide height bar is basically a set of 8 horizontal lines printed on the watch face with the bottom line representing "low" tide and the top line representing "hi" tide. To indicate the height of the tide, an indicator is illuminated alongside one of the horizontal lines. Unfortunately, the tide height bar has no calibration to indicate the height of the tide and the tide height bar is so small that it is extremely imprecise. These drawbacks make the watch taught in the '417 patent impractical for any use that requires accurate knowledge of the tide height. Moreover, there is no way to know when the highs and lows for the day are going to occur.

Another device that displays tide graphically is taught in U.S. Pat. No. 6,295,248. The '248 device allows a user to select a geographic region and then displays the tide for the selected region. Here again, the tide is displayed in a very small display area and is therefore not precise enough to be of much use.

Perhaps to ameliorate the impreciseness of devices that displayed the tide graphically, U.S. Pat. No. 5,299,126 teaches an electronic tide watch that displays tide height as a numerical value. The watch described in the '126 patent gives a user more precise height information than can be gleaned from tide devices that display the tide height graphically. At the same time, however, the device of the '126 patent lacks other useful information such as whether the particular height is a high or low and whether the tide is rising or falling.

Traditional tide calculating devices were generally made for boat navigators and fisherman who needed to know whether the tide was high enough to pass over sand bars, shoals, and the like or whether the tide was low enough for a boat to pass under a bridge. Since early tide devices were used primarily by cargo ships, tide tables produced by the National Oceanic and Atmospheric Administration indicate tide heights at ports rather than at beaches where surfers are likely to be surfing. Thus, such tide tables were not of particular use for surfers who needed to know the tide at a particular local beach, not at a major port. Moreover, the devices that displayed the tide were of little use to surfers because they lacked a frame of reference. That is, devices that displayed the tide height numerically had no frame of reference as to whether the height was a high or a low, rising or falling, and devices that displayed the tide height graphically were imprecise as to the actual tide height.

Thus, there is a need for a tide display device that can display accurate tide information that is useful for surfers.

SUMMARY OF THE INVENTION

The present invention provides a tide display device with a storage mechanism that stores tide information by surf spot. The tide information includes at least a tide height and an associated time of day. The device has a microprocessor that is programmed to display the tide height both graphically and numerically. By displaying the tide height both graphically and numerically, a surfer or other user of the device can associate a particular numeric height with the relative height shown on the graph and can also associate a relative height on the graph with a numeric value. Additionally, a surfer can use the numeric values to determine a desired height for surfing and can use the graph to calculate the time at which the desired height will occur.

Another aspect of the present invention includes the selection of a custom surf spot—one that was not preloaded into the storage mechanism. In this aspect, the device can accept an offset value of between 1 and 120 minutes. Tide heights are calculated for the custom surf spot by applying the offset value to the preloaded surf spot.

In a further aspect of the invention, tide information can be downloaded by a user. The tide information can be downloaded directly into the device using corded or wireless communication paths or the information can be downloaded onto a removable memory component such as a secure digital or "SD" card which can then be inserted into the device.

The inventive subject matter may also include a tide height graph that displays approximately 6 hours of past tide height information and approximately 18 hours of future tide height information. It is contemplated that the graph of tide height information will move or effectively update every half hour.

Various objects, features, aspects and advantages of the present invention will become more apparent from the following detailed description of preferred embodiments of the invention, along with the accompanying drawings in which like numerals represent like components.

BRIEF DESCRIPTION OF THE DRAWING

FIG. 1 is a side view of a tide display device showing a tide height display area.

FIG. 2 is a side view of a tide display device showing a beach selection display area.

FIG. 3 is a schematic of some of the internal components of a tide display device.

FIG. 4 is a side view of a tide display device in heat timer mode.

FIG. 5 is a schematic of a system of loading tide information into a tide display device.

FIG. 6 is a schematic of a tide display device with dual attachment mechanisms.

FIG. 7 is a side view of a tide display device in time mode.

DETAILED DESCRIPTION

FIG. 1 depicts a tide height display area 100 for a tide display device including a tide graph 110, a numerical representation of tide height 120, a unit of measure 125, a moon phase 130, a time of day 140, and a current date 150. It should be understood that the tide height display area 100 is accessed in tide mode, however, the device has other display areas and other modes some of which will be discussed with reference to other figures.

A tide display device is preferably contemplated to be part of a watch (e.g. wrist watch, pocket watch) but it can also be a standalone or desktop device among other things. Thus, the size and shape of a tide display device can vary considerably. One particularly contemplated embodiment, portrayed in FIG. 6, includes a wrist-size tide display device 610 with a removable wrist band 620 (first attachment mechanism) and a Velcro™ strip 630 (second attachment mechanism) for attaching the tide display device to an object such as a car dashboard, a computer monitor, a cell phone, and so on. Other types of secondary attachment mechanisms are contemplated including reusable adhesives, clips, and so on.

The tide graph 110 displayed in FIG. 1 shows that a high tide of 5.6 ft. occurs at 14:18 on Sep. 26, 2004. While the particular beach that this graph applies to is not shown, it is presumed to be the beach that the user has selected. In tide mode, a user can alternately display high and low tides for a selected day with high tides being represented by peaks and low tides by valleys.

Each high and low tide for the day has a corresponding time of day 140. Upon actuation of a user key, the device displays the next tide for the day, whether high or low. For example, the first tide for the day may be a high tide of 4.62 ft at 12:42 am. In this case the graph 110 will shade up to the first high and the numeric representation 120 will show 4.62. Upon a second actuation of a user key, the first low tide of the day can be displayed along with its corresponding time of day. In this case, the graph will shade up to the first low tide displayed.

The numerical representation of tide height 120 shows the tide height at the high or low tide time 140. The numerical tide height 120 is shown with a unit of measure 125 of "FT" (feet). A user of the tide device is able to select the unit of measure between feet, meters, or coefficients. A coefficient is a value that represents change or deviation between high and low tide. The term "coefficient" is used consistently with its known meaning in the art. For example, a coefficient may range from 28 to 120,and in this example, a coefficient of 28 means there is virtually no difference between high and low tides. If the coefficient was 120,the difference would be extreme.

In addition to displaying tide information graphically and numerically, a tide display device has a third tide height indication—moon phase 130. Moon phase 130 dynamically displays the fillness of the moon. Since tides rise and fall due to the gravitational pull of the moon (and sun), the moon phase is considered to be a tide height indication. For instance, the condition known as spring tide occurs around the time of a new moon and also around the time of the full moon. Tides at these particular times are unusually high or low. Neap tide occurs when the moon is at quadrature and during this time high tides are lower and low tides are higher than usual.

Drawing your attention now to FIG. 2, a tide display device 200 in tide mode shows a beach location 210 and the associated beach designation 220. Up to four beaches, labeled "Local Beach", "Beach 1", "Beach 2", and "Beach 3", can be alternately displayed by actuating a proper sequence of user keys 230.

In selecting beaches, a user steps through sequential geographic classifications initially by entering a broad classification such as continent (e.g. North America, Europe, and Asia). Once a continent has been selected, the device displays a list of countries or other regions (e.g. West Coast, France, Australia) that are located within the selected continent. The user continues to step through locations until a desired surf spot (beach location) is displayed (e.g. La Jolla 210 or Cottesloe Beach (not shown). Once the surf spot is selected, a beach designation (e.g Beach 01) is assigned to the selected surf spot.

The following table shows exemplary geographic classifications:

| |
|---|
| North America |
| West Coast |
| Huntington Beach CA |
| Malibu CA |
| Cannon Beach OR |
| East Coast |
| Myrtle Beach SC |
| Cape Cod MA |
| Jacksonville Beach FL |
| Hawaii |
| Maui HI |
| Oahu HI |
| Central America |
| Puerto Rico |
| Mexico |
| Cabo San Lucas |
| South America |
| Brazil |
| Fernando Do Noronha |
| Africa |
| Morocco |
| Casablanca |
| Anchor Point |
| South Africa |
| Cape Town |
| Europe |
| France |
| Etretat |
| Anglet |
| Spain |
| Sardinero |
| Italy |
| Verazze |
| Asia Pacific |
| Australia |
| Western Australia |
| Cottesloe Beach |
| South Australia |
| Parsons Beach |
| Others |
| Tahiti |
| Taapuna |

In addition to selecting one of the surf spots preloaded into storage, a user may select a custom surf spot—one that is not preloaded. In order to select a custom surf spot, the user first selects a preloaded surf spot that is in the geographic vicinity of the custom surf spot. The user is then queried whether to customize the preloaded surf spot. If he responds "Yes", he is prompted to enter a time differential ranging up to 120 minutes, plus or minus. The tide display device will calculate the tide information for the custom surf spot by applying the time differential to the preloaded tide information for the selected surf spot.

In another aspect of the inventive subject matter, a user can view future tide information by selecting a beach designation and then actuating a user key in order to increment the display information by 1 day. For each time the user key is actuated, the tide display information is incremented 1 day. Alternatively, a user can view future tide information by selecting a particular date in the future instead of incrementing one day at a time.

Drawing your attention now to FIG. 3, a tide display device 300 comprises a storage device 310 and a microprocessor 320. Storage device 310 is an SD (secure digital) card, however, it will be understood by one of skill in the art that other types of storage can be used inside the tide display device including hard disk drives and most especially other types of flash memory and EEPROMs (electrically erasable programmable read-only memory). In a preferred embodiment up to two highs and two lows are stored for each of 200 or more locations for each day for 15 years though it should be noted that not every location will have two highs and two lows each day.

Storage device 310 is permanently installed in the tide display and is therefore not readily removable by a user of the device. In another class of embodiments, the storage device is readily removable and replaceable by a user. In order to provide a readily removable and replaceable memory, a tide display device is envisaged to have a slot which is accessible to the user for insertion and removal of memory cards. It should be noted that various sizes and types of removable media are contemplated for this use especially including MMCs (multimedia cards), SD (secure digital) cards, SmartMedia, Memory Stick, and so on.

Microprocessor 320 can be any appropriate processing unit that is capable of performing the functionality described herein. A preferred microprocessor is the Epson 32-bit MCU with built in LCD-controller, however, other appropriate microprocessors will suffice so long as they have the capability of performing the functionality set forth herein FIG. 4 depicts a tide display device 400 in heat timer mode. In this mode, a display device shows a wave count 410, a heat timer 420, and a current time of day 430.

Wave count 410 is a display that is intended to track the number of waves that a surfer catches during a surf contest. Of course, the wave counter can be used for almost anything that requires an incrementally increasing number, but it will most advantageously be utilized by surfers to count waves. A user can increase the wave count by actuating one of the user keys.

Heat timer 420 displays a countdown of time. The heat timer is especially useful to time heats for a surf contest. A user can set the heat timer at between 5 and 120 minutes, and the heat timer will then count down the time until it reaches 0. An additional feature of the heat timer is the sounding of audio signals at 5 minutes and at 30 seconds.

FIG. 5 represents a system for loading tide information into a tide display device. The system includes an oceanographer 510, a web server 520, the Internet 530, a user computer 540, and a tide device 550.

Oceanographer 510 is a professional in the field of tide calculation. It is contemplated that an oceanographer calculates tide heights exclusively for use in the tide display device described herein. "Exclusively" means "solely for" or "to the exclusion of others". Thus, if an oceanographer has calculated tide heights "exclusively for use in the tide display device" that means that such information is contractually prohibited from any use other than in the display device of this invention. By using an oceanographer to calculate tide information that is to be loaded into the tide display device, the information can be made more relevant for surfers. For example, the tide information calculated by the oceanographer encompasses locations that would not otherwise be available in the public domain. Below is a table exemplifying some of the tide information that may be derived by an oceanographer.

Exemplary Tide Information:
Continent: North America
Region: West Coast
Location: Huntington Beach Calif.
Date: Sep. 26, 2004
Low 1: 1.56 ft
Low 1 Time: 9:48
High 1: 5.6 ft
High 1 Time: 14:18
Low 2: 0.6 ft
Low 2 Time: 20:40
High 2: 4.5 ft
High 2 Time: 23:17

After the tide information is calculated by the Oceanographer, it is loaded onto a web server 520. Web server 520 is a computer or series of computers (e.g. a RAID array) that store information which is made available to others. In this case, web server 520 is accessed by a user computer 540 traversing the Internet 530. In preferred systems and methods, a user accesses the web server and then requests information for particular surf spots. By allowing a user to select the surf spots for which he desires information, the memory of the display device is not jammed up with information that the user will never use. In addition, a user going on a vacation to a certain surf spot can download information for that surf spot.

It should be recognized that there are many other paths, devices, protocols, and file transfer methods that can be utilized to transfer the tide information from the oceanographer to the tide device. A particularly contemplated method utilizes a wireless PDA (e.g. Blackberry™) to receive an email containing the tide information. The tide information can then be downloaded to the tide display device using Bluetooth™ or another close range wireless technology. Tide information data can also be downloaded to the tide display device using a wire connected to the user computer on one end and to the tide display device on the other end. Accordingly, a tide display device may have a port 330 such as a USB or a 1394 (i.e. "firewire") for accepting the wire. It may also be advantageous to allow users to separately purchase memory cards that are pre-loaded with tide information. In another class of embodiments, tide information could come from an independent information provider such as a weather or surf content provider (e.g. Weather Information Network™, Surfline™, and Cornwall's Surf Conditions™).

In FIG. 7, a tide display 700 in time mode has a current time 710 including seconds 715, a tide height graph 720, a moon phase 730, a point "0" 740, a horizontal axis 750, a level "0" line 760, and a current time line 770.

It can be observed that the horizontal axis encompasses approximately 6 hours of past tide height information and approximately 18 hours of future tide height information though other breakdowns are within the scope of the inventive concept. It should be observed that point "0" 740 on horizontal axis 750 represents the approximate current time while −6, +6, +12 and +18 represent 6 hours in the past, 6 hours in the future, 12 hours the future, and 18 hours in the future, respectively. Thus, although a single date 760 is depicted on the display, the tide height graph likely will encompass more than one day. For example, if the current time is 9 pm, the graph will encompass the approximate time period between 3 pm on the current day and 3 pm on the next day.

A tide display device has fields that are dynamic and fields that are static. The static fields, which are printed on the face of the display rather than updated programmatically, include current time line 770, level 0 line 760, and horizontal axis 750. On the other hand, the contents of the boxes or pixels that form graph 720 are updated programmatically and therefore can be changed. Here, the pixels are shaded or un-shaded depending on the tide height and whether the heights are past, present, or future.

Current time line 770 is an extension of point "0" 740 (i.e the current time) while level 0 line 760 is preferred to be the mean lower low water level. Mean lower low water level is the average height of all the lower low waters recorded over a 19 year period. Lower low water is the lower of the two low waters on a tidal day. As can be observed in FIG. 1, tide height can fall below the level 0 line. In other less preferred embodiments, level 0 line can represent mean low water, mean sea level, or another value. In any case, level 0 line is used as a point of reference.

Graph 720 is formed by laying out the high and low tides and then plotting them. In order to differentiate between past and future tides, pixels on the left side of the current time line 770 are shaded while those on the right side are not shaded with the exception of the upper level of pixels. A graph is updated periodically and when it is updated, it effectively moves to the left. While the period of time for updating the graph can vary considerably, it is advantageous for the graph to be updated every 30 minutes or less so as to provide relatively current information. In particularly contemplated embodiments, the graph updates every minute or less.

Thus, specific embodiments and applications of a tide display device have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A tide display device, comprising:

a storage mechanism that stores tide information including a tide height and an associated time of day for each of a plurality of surf spots;

a display area that simultaneously displays the tide height for a selected geographic location using both a graph and a numeric value;

a heat timer that tracks a heat time that is displayed in the display area; and a wave counter that tracks a wave count that is displayed in the display area.

2. The device of claim 1, wherein the digital numeric value for the tide height can be displayed in feet, meters, or as a coefficient.

3. The device of claim 1, further comprising a third tide height indication displayed on the display area.

4. The device of claim 3, wherein the third tide height indication is a moon phase.

5. The device of claim 1, wherein the tide information includes up to two highs and two lows for each surf spot.

6. The device of claim 1, wherein the tide information further includes a continent.

7. The device of claim 6, wherein the tide information further includes a country.

8. The device of claim 1, wherein the tide information is calculated by an oceanographer for exclusive use in the tide display device before being loaded into the storage mechanism.

9. The device of claim 1, wherein the tide information is downloaded from a web server.

10. The device of claim 9, further comprising a 1394 port for downloading the tide information.

11. The device of claim 9, configured to use wireless technology for downloading the tide information.

12. The device of claim 1, wherein the graph is displayed as a series of waves with the peaks representing high tides and the valleys representing low tides.

13. The device of claim 1, wherein the graph comprises approximately 6 hours of past tide heights and approximately 18 hours of future tide heights.

14. The device of claim 13, wherein the graph updates every 30 minutes.

15. The device of claim 1, comprising a microprocessor programmed to alternately display tide heights for up to four beaches.

16. The device of claim 1, comprising a microprocessor programmed to accept an adjustment for a custom beach and to display tide height for the custom beach.

17. The device of claim 1, wherein the storage mechanism is a removable flash memory card.

18. The device of claim 1, comprising a first attachment mechanism that is adapted to attach to a wrist band.

19. The device of claim 18, further comprising a second attachment mechanism comprising Velcro™.

20. The device of claim 18, further comprising a second attachment mechanism comprising an adhesive.

21. A tide display device, comprising:

a microprocessor programmed to change a display of information in response to a change of mode initiated by a user of the device, wherein the modes include a time display mode that simultaneously displays a tide height graph and a current time, a tide selection mode that allows the user to select a beach, and a wave counter mode that allows the user to track and increment a wave count.

22. The tide display device of claim 21, wherein the display of information includes a numeric value representing a tide height.

23. The tide display device of claim 22, wherein the numeric value for the tide height can be displayed in feet, meters, or as a coefficient.

24. The tide display device of claim 23, wherein the coefficient is a value that represents a change between high tide and low tide.

25. The tide display device of claim 21, wherein the time display mode simultaneously displays a numeric value representing a tide height with the tide height graph and the current time.

26. The tide display device of claim 25, wherein the numeric value for the tide height can be displayed in feet, meters, or as a coefficient.

27. The tide display device of claim 26, wherein the coefficient is a value that represents a change between high tide and low tide.

28. The tide display device of claim 21, wherein the tide height graph comprises past tide heights and future tide heights and wherein a ratio of a number of hours of the past tide heights over a number of hours of the future tide heights is 1/3.

29. The tide display device of claim 21, wherein the tide height graph has a current time line that separates past tide heights and future tide heights.

30. The tide display device of claim 29, wherein the tide height graph moves relative to the current time line.

31. The tide display device of claim 29, wherein the tide height graph is updated every 30 minutes.

32. The tide display device of claim 21, wherein the tide height graph is displayed as a series of waves with the peaks representing high tides and the valleys representing low tides.

33. The tide display device of claim 21, wherein the tide height graph is displayed as a number of bars with the peaks representing high tides and the valleys representing low tides.

34. The tide display device of claim 21, wherein the microprocessor is further programmed to accept an offset for a custom beach and to display tide height for the custom beach.

35. The tide display device of claim 21, wherein the time display mode simultaneously displays tide information using a moon phase indicator with the tide height graph and the current time.

36. The tide display device of claim 21, wherein the microprocessor is further programmed to alternately display tide heights for up to four beaches.

37. The tide display device of claim 21, wherein the modes further includes a heat timer mode that displays a heat time.

38. The tide display device of claim 21, wherein the tide height graph is updated every 30 minutes or less.

* * * * *